US006067755A

United States Patent [19]

Maanum

[11] Patent Number: 6,067,755

[45] Date of Patent: May 30, 2000

[54] COVER ARRANGEMENT FOR ROOF GUTTERS; AND, METHOD

[76] Inventor: Armand D. Maanum, 2300 Douglas Dr. North, Minneapolis, Minn. 55422

[21] Appl. No.: 08/911,567

[22] Filed: Aug. 14, 1997

[51] Int. Cl.[7] ..... E04D 13/064

[52] U.S. Cl. ..... 52/12; 52/16; 52/15; 248/48.1

[58] Field of Search ..... 52/12, 11, 15, 52/16; 248/48.1, 48.2; 405/118, 120

[56] References Cited

U.S. PATENT DOCUMENTS

| | | | |
|---|---|---|---|
| 3,977,135 | 8/1976 | Hunley, Jr. | 52/12 |
| 4,032,456 | 6/1977 | Berce | 52/12 X |
| 4,351,134 | 9/1982 | Clarkson | 52/12 |
| 4,945,690 | 8/1990 | Otto | 52/12 |
| 5,251,410 | 10/1993 | Carey | 52/12 |
| 5,388,377 | 2/1995 | Faulkner | 52/11 |
| 5,459,965 | 10/1995 | Mecketroth | 52/11 X |
| 5,586,837 | 12/1996 | Udelle | 52/12 X |

*Primary Examiner*—Carl D. Friedman
*Assistant Examiner*—Winnie S. Yip
*Attorney, Agent, or Firm*—Merchant & Gould P.C.

[57] ABSTRACT

A cover arrangement for roof gutters is provided. The cover arrangement includes a plurality of cover segments each of which includes an elongate hinge pin having a mounting plate thereon and pivotal gutter cover segment thereon. Preferred configurations, sizes and overlap patterns for adjacent cover segments are provided. Also an assembly comprising a roof, roof gutter and cover arrangement is provided. Methods of assembly and use are also described.

15 Claims, 5 Drawing Sheets

FIG. 1
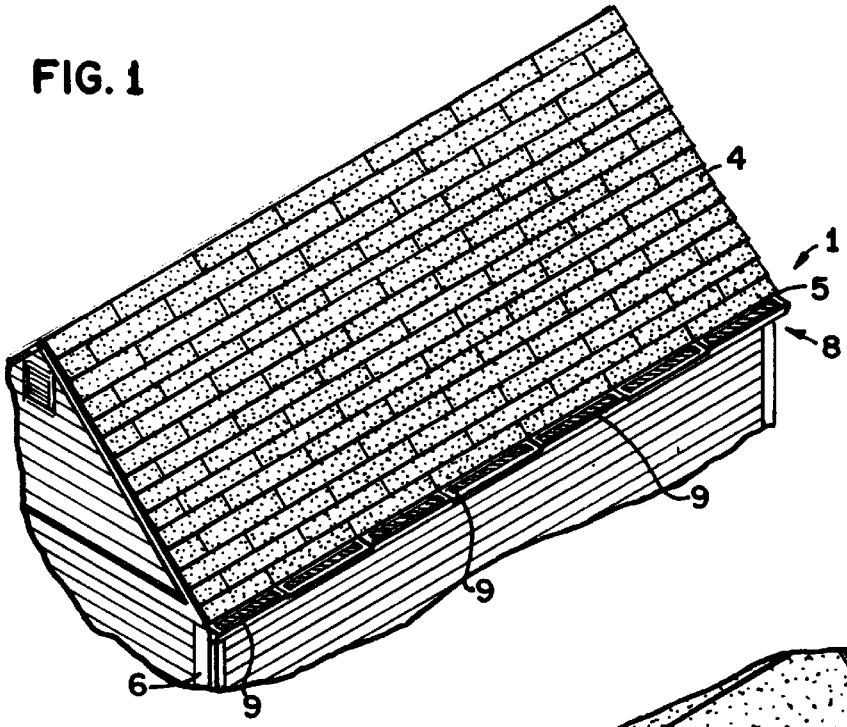
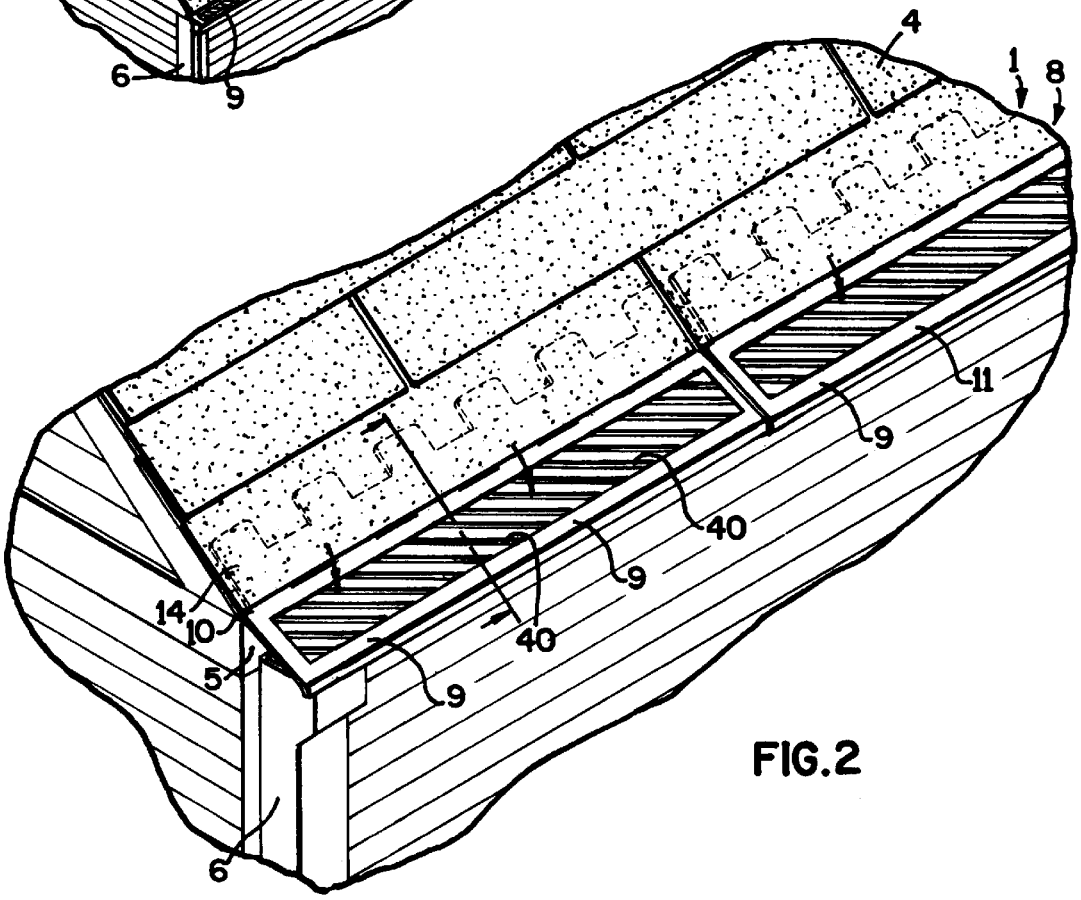
FIG. 2

COVER ARRANGEMENT FOR ROOF GUTTERS; AND, METHOD

FIELD OF THE INVENTION

The present invention relates to materials, arrangements and methods for protecting roof gutters and/or other parts of buildings from blockage and/or water runoff damage. It particularly concerns arrangements that can be mounted over a roof gutter, to advantage. The present disclosure is also concerned with methods of assembly and use. The arrangement can be used even where there are no gutters, to advantage.

BACKGROUND OF THE INVENTION

Many buildings include gutters mounted along portions of the roofing edge, at the bottom end of the roof taper or slant. The gutters generally have an open upper surface, and collect run-off water from rainstorms, etc. The water is then typically directed, by the gutter, to a downspout or series of downspouts, to be drained to the ground.

Conventional gutter arrangements, with open tops, have a propensity to become clogged with roof debris. Such debris generally includes leaves and tree branches, but may also include items such as paper and cardboard, and fireplace debris, etc.

In order to block roof debris from entering the gutters, sometimes long screens are positioned over the gutters. Such screens, which generally comprise woven wire extensions, are typically placed along the complete length of a gutter, and over the gutter. The screens will catch leaves and tree debris, etc., as it is washed downwardly toward the gutter. Unfortunately, the screens also become clogged by the leaves and debris, and need to be periodically removed and cleaned. Cleaning such woven wire screens can be a difficult and time-consuming process.

SUMMARY OF THE INVENTION

According to certain applications of the disclosure provided herein, a cover arrangement for roof gutters is provided. The cover arrangement generally includes a plurality of cover segments. Each cover segment includes: a hinge pin or hinge pin arrangement; a mounting plate secured to the hinge pin (or hinge pin arrangement); and, a gutter cover pivotally secured in the cover segment. Generally each hinge pin has a longitudinal axis and extends over a length of at least 1 foot (at least 30 cm), typically 2.5–3.5 feet (i.e. 76–107 cm). Preferably 0.25 inch (0.635 cm) diameter or less hinge pins will be used.

Generally, the plurality of gutter cover segments are each mounted for pivotal movement of the covers, about the associated hinge pin longitudinal axis, over an arc of at least 30°, and typically, when assembled for use over gutters, for pivotal movement over an arc of at least 60°.

Preferably the mounting plates are sized and configured for at least partial positioning under a roof surface edge in use. For example, they will be mounted along an edge of a roof underneath edge tiles or shingles.

Preferably each gutter cover is sized and configured to extend over an adjacent roof gutter, in use. Also, preferably each gutter cover has a water permeable section therein, and each has a length of at least 2 feet (61 cm), typically 2.5 to 3.5 feet (76–107 cm), and most preferably not more than 4 feet (122 cm).

In certain alternate embodiments, each gutter cover can be mounted to a separate hinge plate, and it is the hinge plate which is then directly, pivotally mounted to the hinge pin. Also in some alternate applications, each mounting plate can be secured to a separate hinge plate. In the variations of this paragraph, even though the connection between the cover and hinge, and/or mounting plate and hinge pin may not be "direct" each will still be referred to as pivotally mounted on the hinge pin.

In certain preferred embodiments, the gutter cover segment has a central section with a plurality of apertures, most preferably slots, therein. In preferred configurations, the slots extend generally parallel to one another, and at an acute angle, i.e., an angle of greater than 0° and less than 90°, relative to the longitudinal axis of the hinge pin. Preferably the slots extend at an angle within the range of 30° to 60°, relative to the hinge pin longitudinal axis. In one preferred embodiment, an angle of 45° for the slots is used.

Preferably each slot is about 0.0625 inch (0.16 cm) to 0.125 inch wide (0.32 cm) and each is spaced from the next adjacent slot by a distance of at least 0.0625 inch (0.16 cm), preferably no more than 0.125 inch (0.32 cm), and typically about 0.094 inch (0.24 cm). Preferably at least 60% (more preferably at least 65%) of the slots are 5 inches to 7 inches (12.7–17.8 cm) long. In some embodiments, corner slots may be shorter, for example in the preferred configurations indicated in the drawings.

In certain alternate embodiments, each cover can comprise two sections: a frame section; and, a separate center slotted section. In such instances, the frame section would generally have an outer, flat or planar, frame surface which would define a central opening. The slotted section would then be positioned within the central opening. The slotted section could be permanently positioned within the opening, for example by brazing, or it could be removably secured in position.

Whether a single piece or two-piece cover is used, generally the cover defines an outer frame and a central permeable area. In addition to defining an outer planer frame surface, generally the frame section has an outer edge and downwardly depending lip. The downwardly depending lip generally defines a lip which extends or projects at a downward bend or angle, relative to the frame section outer flat frame surface. This can typically be accommodated by bending the material of the frame section.

According to the present invention, an overall assembly comprising: a roof with a roof edge; a gutter mounted along the roof edge; and, a cover arrangement as described herein mounted in covering relation to the gutter, is provided. Also, according to the present invention, a method of covering a gutter is provided. The method generally comprises mounting, along a roof edge and above a gutter extending therealong, a cover arrangement as described herein.

BRIEF DESCRIPTION OF THE DRAWINGS

FIG. 1 is a fragmentary perspective view of a roof section with a gutter thereon; a gutter cover arrangement according to the present invention being shown installed in extension over the gutter;

FIG. 2 is an enlarged fragmentary view of the arrangement shown in FIG. 1;

FIG. 3 being taken along line 3—3, FIG. 2, with respect to the cross-sectional portion;

DETAILED DESCRIPTION

Figure 3:
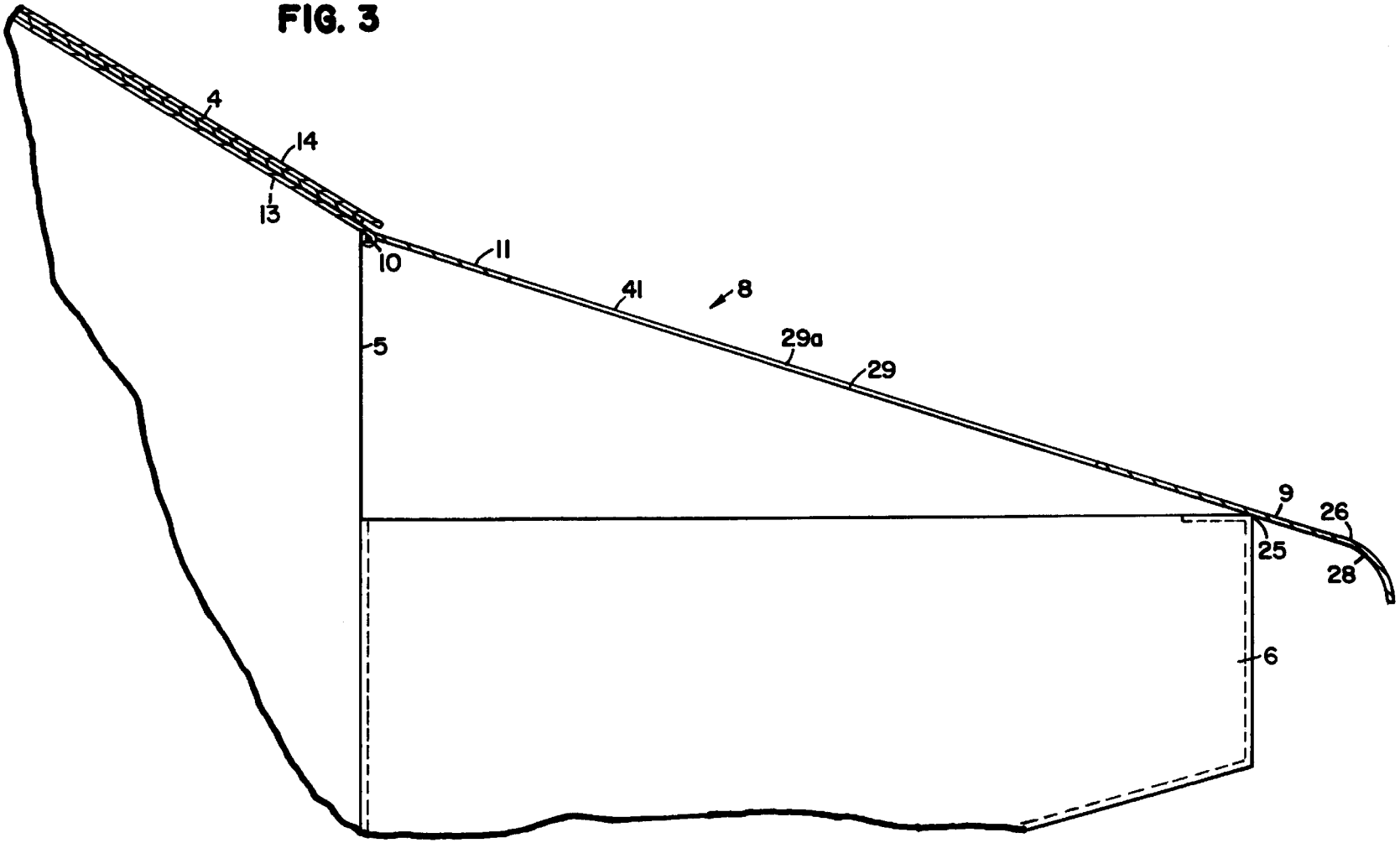
FIG. 3 is an enlarged schematic partially cross-section view of the arrangement shown in FIGS. 1 and 2.

The reference numeral 1, FIG. 1, generally depicts an assembly according to the present invention.

The assembly 1 generally comprises a section of conventional roofing 4 having a roof edge 5 with a conventional gutter arrangement or gutter 6 mounted thereon. According to the present invention, positioned over gutter 6 is cover arrangement 8. It is foreseen that in typical applications, except for the features of cover arrangement 8, assembly 1 may be conventional. That is, the cover arrangement 8 may be used with conventional roofing sections 4 and gutter arrangements 6. Of course the new cover arrangement 8 can be adapted to new designs of roofs and gutters. It is foreseen that, typically, roof edge 5, and gutter 6, will extend over a longitudinal extension of at least 6 feet (182 cm), typically 20 to 50 feet (6–15 meters).

Referring to FIGS. 2 and 3, the cover arrangement 8 generally comprises a plurality of cover segments 9. Each cover segment 9 includes an elongate hinge pin arrangement or hinge pin 10 on which is mounted a pivotal cover section or cover 11. Hinge pin 10 has a central longitudinal axis which is the pivot axis for the cover section 11.

Figure 5:
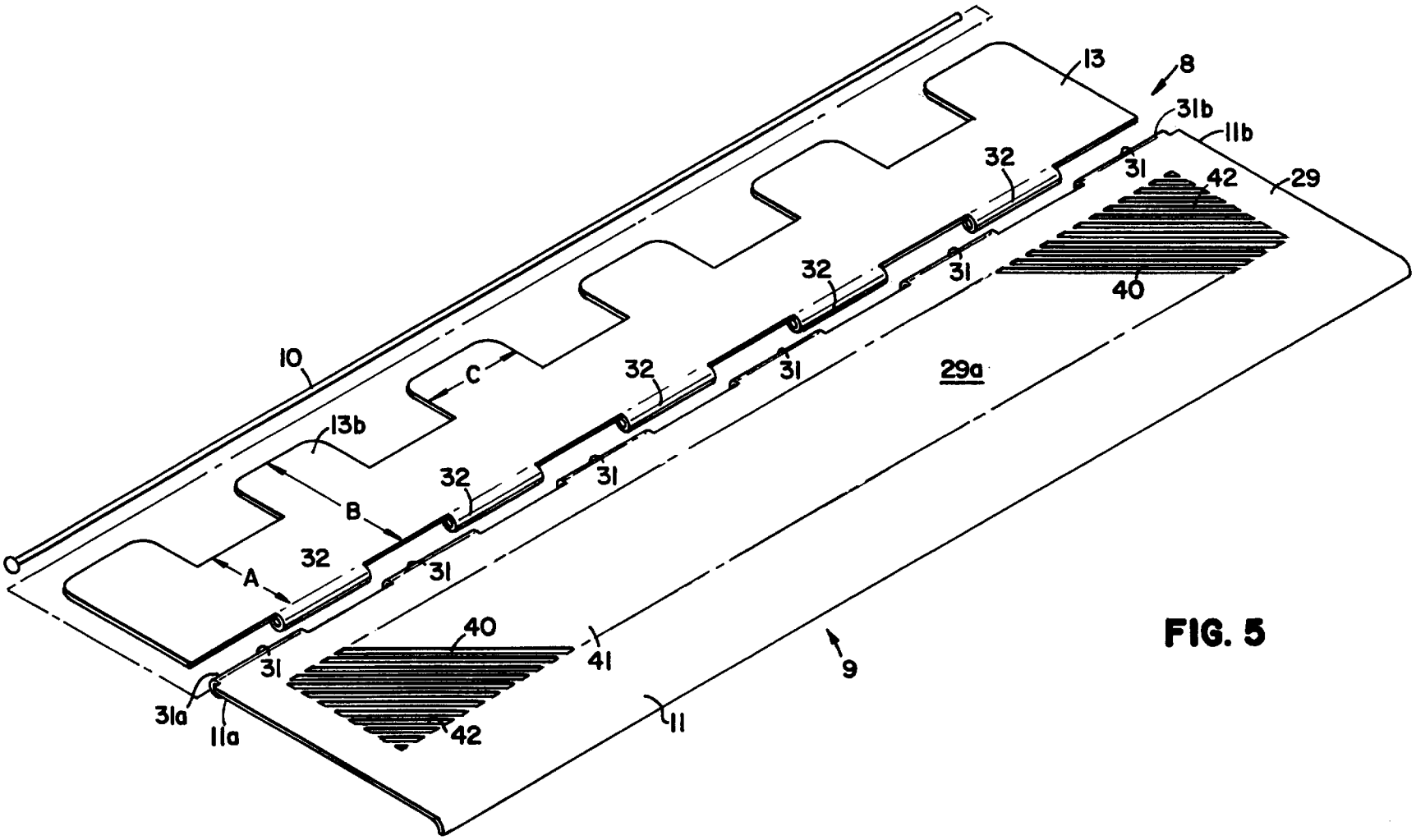
FIG. 5 is an exploded, perspective, view of a first cover section configuration.

Referring to FIGS. 2, 3 and 5, also mounted to each hinge pin 10 is a mounting plate 13. Each mounting plate 13 can be secured under the edge tiles or shingles 14, etc., as in FIG. 2, to secure hinge 10 in extension along edge 5. The securing can be by a variety of methods, for example frictional, various screw arrangements, nail arrangements, and/or adhesive arrangements can be used.

Referring to FIGS. 1–4, in general the arrangement 8 comprises a plurality of separate sections or segments 9. It is foreseen that in typical arrangements, each segment 9 will be at least 2 feet (60 cm) long, and no more than about 4 feet long (120 cm), and preferably each is about 2.5 to 3.5 feet (76–107 cm) long. The segments 9 are preferably mounted such that the cover 11 of each one is either overlapped by, or overlaps, the next adjacent one by about 0.25 to 2.0 inches (0.635–5 cm). In typical preferred applications, each inch pin 10 is about 32 inches (81 cm) long and each cover 11 is about 32.5 inches (82.5 cm) long, with each cover 11 overlapping or overlapped by a next adjacent cover by 0.25 inches (0.6–0.7 cm).

Figure 4:
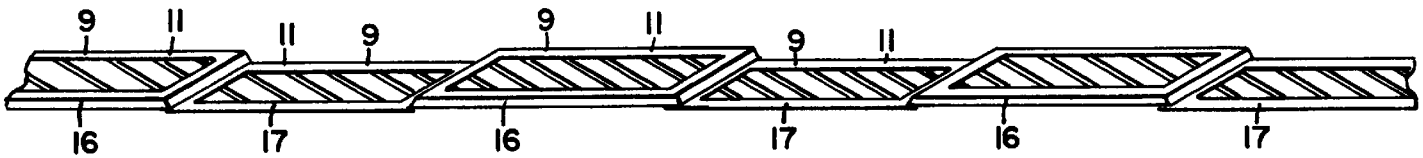
FIG. 4 is a schematic view of a preferred cover overlap arrangement for use with arrangements according to the present invention.

Referring to FIG. 4, one preferred manner of overlap is shown schematically. The preferred manner of overlap is of a "brick layer" type overlap. That is, the set of covers 11 can be divided into two alternating sets: a first set 16 of "overlapping" covers 11, each one of which is positioned in overlapping arrangement to a member of a second set 17 of adjacent "overlapped" covers 11. Each member of the second set 17, then, is positioned underneath any adjacent segments 16. Thus, any "overlapping" section 16 can be lifted independently of adjacent segments 17, and swung through the hinge arc; and, any overlapped section 17 can be lifted and pivoted, but only with lifting of the two immediately adjacent segments 16 as well.

As a result of this overlapping construction, access to any gutter section for cleaning, etc., is relatively straightforward, and does not require cumbersome dislocation of the entire cover arrangement 8. At most, only pivoting of three relatively short sections is required.

When adjacent covers are mounted as indicated in the "brick layer" fashion of FIG. 4, in general the various hinge pins 10 of adjacent segments 9 will not be aligned coaxially, but rather they will be mounted offset somewhat to facilitate the overlap. This can easily be accommodated by adjustment in the positioning of the segments 9, or by using alternately bent metal pieces.

Preferably each cover 11 is constructed and arranged such that, when operably positioned over a gutter 6, the cover 11 can be pivoted through an arc of at least 30°, and preferably at least 60°, for ease of access to the interior of the gutter 6, for cleaning. It is foreseen that in typical arrangements, a pivoting of about 70° or more, will be feasible.

The pivotal covers 11 can be secured to the hinge pin 10 in a variety of manners. One approach will be understood by reference to FIG. 5. An alternate approach will be understood by reference to FIGS. 6 and 7.

Referring first to FIG. 5, in FIG. 5, a segment 9 including hinge pin 10 is depicted, in exploded view. The segment 9 comprises a cover 11 mounting plate 13 and hinge pin 10. The cover 11 includes spaced pin receiving tubes 31; and, the mounting plate includes spaced pin receiving tubes 32. Tubes 31 and 32 are oriented so that they can be engaged in an alternating manner, during assembly, with hinge pin 10 extending therethrough. Thus, pin 10 secures cover 11 and mounting plate 13 to one another in the manner of a piano hinge. Note that end tubes 31*a* and 31*b* of cover 11 are recessed slightly, from end edges 11*a* and 11*b* somewhat, preferably about 0.25 inch (0.635 cm). Hinge pin 10 is preferably about 0.5 inch (1.25 cm) shorter than a length of extension of cover 11. This facilitates mounting with overlap, as shown in FIG. 4.

Figure 7:
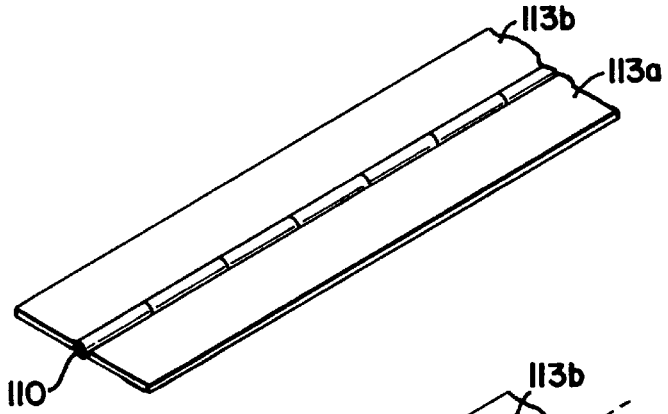
FIG. 7 is a fragmentary perspective view of the arrangement shown in FIG. 6.
Figure 6:
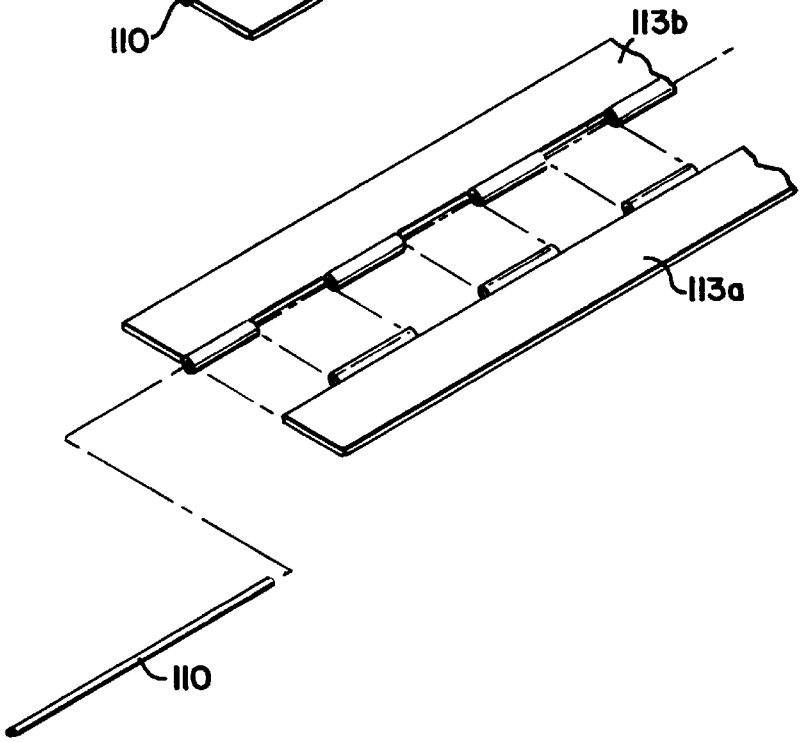
FIG. 6 is a further exploded, fragmentary, perspective view of an alternate component useable in arrangements according to the present invention.

The approach represented in the schematic of FIGS. 6 and 7 is an alternate. Here, hinge pin 110 projects through tubes formed in plates 113*a* and 113*b*. That is, the assembly of FIGS. 6 and 7 would comprise a type of piano hinge. With such an assembly, a cover (analogous to cover 11) and mounting plate (analogous to mounting plate 13), but without hinge pin receiving tubes thereon, would be secured to the piano hinge by welding, brazing or other mechanical or adhesive means. Even in such embodiments, the cover and mounting plate would be referred to as "pivotally" mounted on the hinge pin.

To summarize, in the first embodiment (FIG. 5), each of the plates and segments include a hinge tube thereon, through which the hinge pin extends, to generate the hinge. In the second approach (FIGS. 6 and 7), the hinge is a separate mechanical construction from the plates 13 and the covers 11; and, the covers 11 and plates 13 are secured to the hinge plates, for example by welding or other methods of attachment. Of course, other alternatives, for example in which the hinge comprises tubes on certain pieces but plates with attachment for other pieces, are possible.

Preferably the cover arrangement 8 is made of a size and configuration such that it will slant downwardly as it extends over the gutter 6. This is demonstrated in the view of FIG. 3. This will typically be accomplished by ensuring that the hinge 10 is mounted above (typically 1 to 1.5 inches or 2.5 to 3.75 cm) the outer edge 25 of the gutter 6. Preferably, the pivotal cover 11 includes an outer edge lip 26 which extends over gutter edge 25 and then depends (bends) downwardly, around bend 28, a distance of at least about 0.25 inch (0.635 cm).

Still referring to FIG. 3, note that between bend 28 and the region of hinge pin 10, each cover 11 includes a flat section 29 which defines and circumscribes a central, permeable, area 29*a*. Flat region 29 will sometimes be referred to herein as a frame section or frame.

Referring to FIG. 2, for the preferred arrangement shown, each segment 11 includes therein a water permeable section comprising a plurality of apertures, most preferably in the form of slots 40. Preferably at least 60% of the slots (more preferably at least 65%) are at least about 5 inches (12.7 cm) long and at least 0.0625 inch (0.25 cm) wide. Most preferably at least 60% of the slots (more preferably at least 65%) are 5 inches to 7 inches (12.7–17.8 cm) long, and 0.0625 to 0.125 inch (0.15 cm–0.30 cm) wide, when the cover arrangement 8 is for mounting over a conventional gutter 6 which is 6.5 inches (16.5 cm) wide at its top. Also, preferably the slots are parallel to one another and are spaced apart a distance of about 0.0625 to 0.125 inch (0.15–0.3 cm). The preferred slots are 0.094 inch (0.24 cm) wide and spaced 0.094 inch (0.24 cm) apart. The slots allow water to pass through the covers 11 and into the gutter 6, leaving leaf debris, tree debris, etc. on the upper surface 41 (FIG. 3) of the covers 11. Preferably the slots 40 are oriented in a diagonal pattern, with the slots 40 parallel to one another, as shown in the top plan view of FIGS. 2 and 5. That is, preferably the slots 40 extend at an acute angle relative to the hinge pin longitudinal axis. By "acute angle" in this context, it is meant that the projected angle between the slots and the hinge pin 10 or hinge pin longitudinal axis is greater than 0° and less than 90°. Preferably it is within the range of 30°–60°, most preferably about 45°. This allows the slots 40 to be longer than the width of gutter 6. As a result, each slot 40 allows for greater fluid flow therethrough (than shorter slots). This will facilitate cleaning of the slots 40, and also drainage into the gutter 6, rather than overflow along upper surface 41 and past gutter 6 in a rainstorm. For example, if the slots 40 were perpendicular to the gutter extension, and spaced from one another, the spaces between the slots would be places for water overrun to more easily occur; and, each slot would be shorter and thus more easily plugged by debris. It is noted that for the arrangement shown in FIG. 5, the slots 40 are arranged in a rectangular pattern. Thus, corner slots at regions 42 are shorter than the remainder.

In typical arrangements, in which covers 11 are formed from sheet steel or sheet aluminum, the slots 40 can be provided by conventional die cutting methods. It is foreseen that this will, typically, be convenient and relatively inexpensive.

Figure 9:
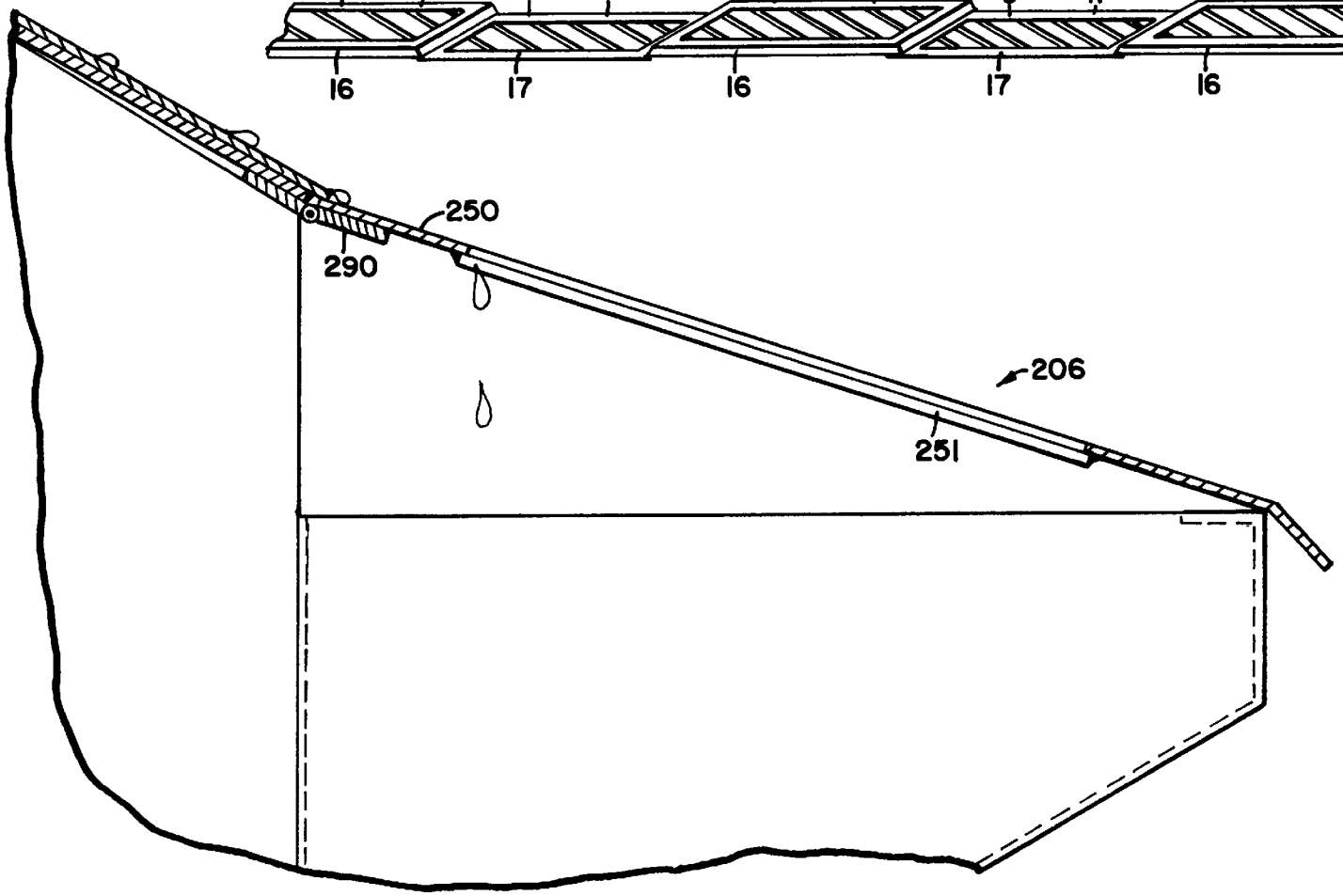
Figure 8:
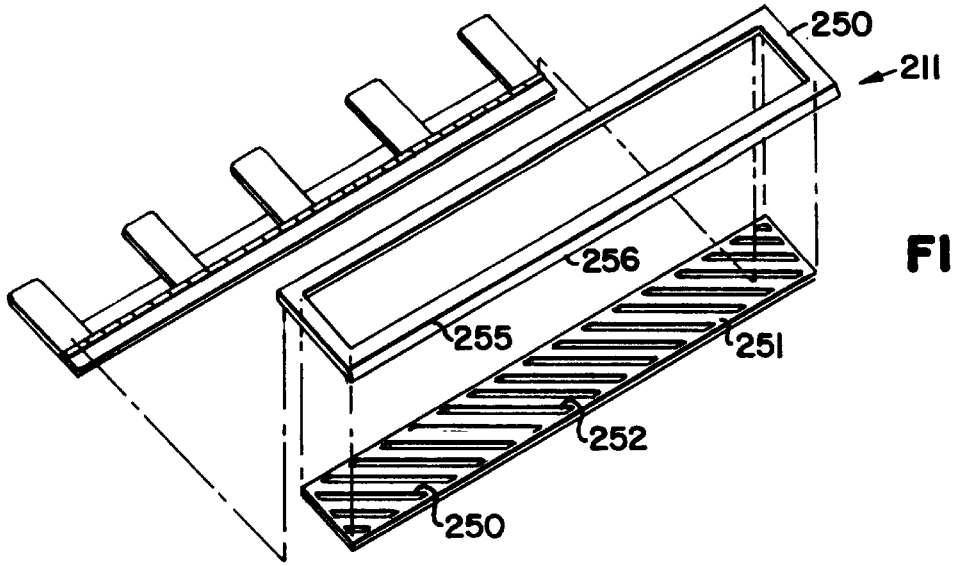
FIG. 8 is an exploded schematic view of a second alternate embodiment of an arrangement according to the present invention; and, FIG. 9 is a schematic enlarged cross-sectional view generally analogous to FIG. 3 but shown involving the embodiment of FIGS. 6 and 7.

Attention is now directed to FIG. 8, in which an alternative construction for cover segment 209 is provided. Referring to FIG. 8, segment 209 comprises a cover 211 which has two pieces: an outer frame 250; and, an inner permeable piece 251. Slots 252 are positioned in inner piece 251. Inner piece 251 is then welded or brazed to an underside of frame 250, for permanent attachment thereto. In this manner, frame 250, with bend 255 and depending lip 256 therein, can be manufactured easily, and then a pre-formed slotted piece 251 can be attached thereto, to provide for the slots. Of course, an arrangement which allows for selected separation (i.e., more temporary attachment) of parts 250 and 251 could be used, allowing for one of the two parts (250, 251) to be changed or serviced more conveniently. Any of the types of hinge constructions described above can be used with this embodiment. In FIG. 9, the segment 206 is depicted in cross-section, mounted over a gutter 280. In FIG. 9, a separate piano hinge 290 is depicted.

Preferably, arrangements according to the present invention are constructed such that the cover 11 is black, and thus will act as a black body radiator. This will facilitate the removal of, or avoidance of, snow and ice dams in the winter.

More specifically, a black object will tend to absorb solar radiation (radiation in the electromagnetic spectrum). The energy absorbed would then be radiated back, greatly as heat. This will tend to melt snow or ice in the vicinity of the cover 11, inhibiting ice dam build-up, in the winter.

It is also noted that the declination angle of the cover 11, over the gutter 6, is advantageous. Preferably an angle which is approximately the same angle as the standard roof pitch, i.e. about 18°, is used. This can be accomplished by appropriate positioning of the hinge, relative to the roof edge. In some instances, the metal bends where the piano hinge are formed can be used to facilitate this. This will facilitate a self-cleaning arrangement.

It is noted that arrangements according to the present invention can be used on buildings which have no gutters, such as garages or out-buildings, as an extension of, or a substitute for, a soffit. To accomplish this, a brace or bracket system would be mounted along the edge of the building, and then the cover arrangement would be supported by the brace or bracket. This would help inhibit water from running down the walls of the building, thus facilitating preservation of the wood and paint.

A Specific Embodiment

In this section, a specific embodiment will be provided. From this, and the previous descriptions, general applications of the present invention will be better understood.

Assume a gutter which has an upper width of about 6.5 inches (16.5 cm).

Preferably, each hinge pin would be about 32 inches (81 cm) long, with each cover about 32.5 inches (82.55 cm) long. Preferably the hinge pin and the cover are engaged such that the cover 11 extends a distance about 0.25 inch (0.635 cm) beyond the hinge pin, at each end.

Preferably, each mounting plate would be configured analogous to the mounting plate 13 viewable in FIG. 5, with a length of about 32 inches (81 cm) and a width in region A of about 4 inches (10 cm). Each tongue 13*b* would be about 6 inches (15.2 cm) wide in the direction of dimension B and about 2 inches (5 cm) wide in the dimension indicated by C.

Still referring to FIG. 5, each cover 11 would be about 8 inches (20 cm) wide, along edges 11*a* and 11*b*, with approximately 1 inch (2.5 cm) used along and on a downward side of the curl.

The preferred slots would be at a 45 degree angle relative to the end 10. Preferably the slots would define a central rectangular area about 4.5 inches by 30 inches (11.4×76.2 cm). Preferably each slot would be about 1/16 inch to 3/32 inch (0.159 cm–0.24 cm) wide, and would be spaced from the next slot by the same distance. The slots would preferably be die cut in the metal piece from which cover 11 is formed.

The entire assembly would preferably be painted black on top for heat absorption and white on the bottom.

What is claimed is:

1. A cover arrangement for a roof gutter; said cover arrangement comprising:

(a) a plurality of hinged cover segments; each hinged cover segment comprising:

(i) a hinge pin having a longitudinal axis and a length of at least 1 foot;

(b) a mounting plate secured to the hinge pin and extending outwardly therefrom in a first direction;

(i) said mounting plate having at least a portion sized and configured for positioning under a roof surface edge, in use; and, (c) a gutter cover pivotally secured to said cover segment by and for movement around said hinge pin longitudinal axis by an arc of at least 30°;

(i) said gutter cover being sized and configured to rest over a roof gutter, in use;

(ii) said gutter cover having a water permeable section therein;

(iii) said gutter cover having a length of at least 2 feet;

(iv) said gutter cover adapted to pivot on an edge nearest the roof when in use;

(d) said plurality of gutter covers comprising a first set of overlapping segments and a second set of overlapped segments;

(i) a member of said first set of segments alternating and overlapping with a member of said second set of segments by a longitudinal extension, in a longitudinal direction.

2. A cover arrangement according to claim 1 wherein:

(a) each gutter cover is secured to the hinge plate which is pivotally mounted on said hinge pin.

3. A cover arrangement according to claim 2 wherein:

(a) each mounting plate is secured to the hinge plate.

4. A cover arrangement according to claim 1 wherein:

(a) each gutter cover includes a central section having a plurality of slots therethrough;

(i) said slots in each gutter cover being parallel to one another and extending at an acute angle relative to said hinge pin longitudinal axis.

5. A cover arrangement according to claim 4 wherein:

(a) each slot extends at an angle of between 30° to 60° relative to said hinge pin longitudinal axis.

6. A cover arrangement according to claim 4 wherein:

(a) each slot is 0.0625 inch to 0.125 inch wide and is spaced from any next adjacent slot by a distance of 0.0625 inch to 0.125 inch.

7. A cover arrangement according to claim 4 wherein:

(a) at least 60% of slots in each cover segment are 5 inches long.

8. A cover arrangement according to claim 1 wherein:

(a) each gutter cover comprises a frame section and a separate center slotted section;

(i) said frame section defining a central opening at least 1.5 feet long; and, (ii) said center slotted section being mounted in covering relation to said central opening.

9. A cover arrangement according to claim 1 wherein:

(a) each gutter cover has an outer, downwardly turned, lip.

10. A cover arrangement according to claim 9 wherein:

(a) said downwardly turned lip is at least 0.2 inches wide.

11. A cover arrangement according to claim 1 wherein:

(a) each overlapping segment overlaps a next adjacent overlapped segment by said longitudinal extension of at least 0.125 inch.

12. An assembly comprising:

(a) a roof having a downward roof taper to a roof edge having a length of at least 6 feet;

(b) a gutter mounted along said roof edge and having a length of at least 6 feet; and, (c) a cover arrangement mounted along said roof edge and above said gutter; said cover arrangement comprising a plurality of cover segments each of which comprises:

(i) a hinge pin having a longitudinal axis and a length of at least 1 foot;

(ii) a mounting plate secured to the hinge pin and extending outwardly therefrom in a first direction;

(A) said mounting plate being at least partially positioned under a surface along said roof edge;

(iii) a gutter cover pivotally secured to said cover segment by and for movement around said hinge pin longitudinal axis by an arc of at least 30°;

(A) said gutter cover being sized and configured to rest over said roof gutter;

(B) said gutter cover segment having a water permeable section therein; and, (C) said gutter cover section having a length within the range of 2 feet–4 feet;

(D) said gutter cover pivoting on said edge nearest the roof when in use;

(iv) said plurality of gutter covers comprising a first set of overlapping segments and a second set of overlapped segments;

(A) a member of said first set of segments alternating and overlapping with a member of said second set of segments by a longitudinal extension, in a longitudinal direction.

13. An assembly according to claim 12 wherein:

(a) each of said gutter covers slant downwardly in extension over said gutter from said roof edge toward an outer edge of said gutter.

14. An assembly according to claim 13 wherein:

(a) said slant downwardly is at an angle of 10° to 30°, relative to horizontal.

15. A method of covering a gutter comprising a step of:

(a) mounting along a roof edge, and above a gutter extending therealong, a cover arrangement comprising a plurality of cover segments; each cover segment comprising:

(i) a hinge pin having a longitudinal axis and a length of at least 1 foot;

(ii) a mounting plate secured to the hinge pin and extending outwardly therefrom in a first direction;

(A) said mounting plate being positioned under said roof edge;

(iii) a gutter cover pivotally secured to said cover segment by and for movement around said hinge pin longitudinal axis by an arc of at least 30°;

(A) said gutter cover being sized and configured to rest over the roof gutter, in use;

(B) said gutter cover having a water permeable section therein; and, (C) said gutter cover section having a length of at least 2 feet;

(D) said gutter cover pivoting on an edge nearest the roof when in use;

(iv) said plurality of gutter covers comprising a first set of overlapping segments and a second set of overlapped segments;

(A) a member of said first set of segments alternating and overlapping with a member of said second set of segments by a longitudinal extension, in a longitudinal direction.

* * * * *